US010748731B2

(12) United States Patent
Huang et al.

(10) Patent No.: US 10,748,731 B2
(45) Date of Patent: Aug. 18, 2020

(54) ELECTRON GUN AND X-RAY SOURCE AND CT DEVICE HAVING THE ELECTRON GUN

(71) Applicants: TSINGHUA UNIVERSITY, Beijing (CN); Nuctech Company Limited, Beijing (CN)

(72) Inventors: Wenhui Huang, Beijing (CN); Dongsheng Zhang, Beijing (CN); Qingxiu Jin, Beijing (CN); Chengjun Tan, Beijing (CN); Donghai Liu, Beijing (CN); Qun Luo, Beijing (CN); Chuanxiang Tang, Beijing (CN)

(73) Assignees: TSINGHUA UNIVERSITY, Beijing (CN); NUCTECH COMPANY LIMITED, Beijing (CN)

( * ) Notice: Subject to any disclaimer, the term of this patent is extended or adjusted under 35 U.S.C. 154(b) by 217 days.

(21) Appl. No.: 15/856,251

(22) Filed: Dec. 28, 2017

(65) Prior Publication Data

US 2018/0190464 A1 Jul. 5, 2018

(30) Foreign Application Priority Data

Dec. 29, 2016 (CN) ..... 2016 1 1247743

(51) Int. Cl.

| | |
|---|---|
| ***H01J 3/02*** | (2006.01) |
| ***H01J 35/06*** | (2006.01) |
| ***H01J 35/14*** | (2006.01) |

(52) U.S. Cl.

CPC ..... *H01J 3/028* (2013.01); *H01J 3/027* (2013.01); *H01J 35/06* (2013.01); *H01J 35/14* (2013.01); *H01J 2235/068* (2013.01)

(58) Field of Classification Search

CPC .. H01J 3/028; H01J 3/027; H01J 35/14; H01J 35/06; H01J 2235/068; H01J 3/024

See application file for complete search history.

(56) References Cited

U.S. PATENT DOCUMENTS

| | | | | |
|---|---|---|---|---|
| 4,646,338 A * | 2/1987 | Skillicorn | ..... | H01J 35/04 378/110 |
| 5,509,045 A * | 4/1996 | Kautz | ..... | H01J 35/20 378/121 |
| 6,111,932 A * | 8/2000 | Dinsmore | ..... | A61N 5/1001 378/136 |
| 7,801,277 B2 * | 9/2010 | Zou | ..... | H01J 35/065 378/119 |

(Continued)

FOREIGN PATENT DOCUMENTS

| | | |
|---|---|---|
| CN | 1127421 A | 7/1996 |
| CN | 1509492 A | 6/2004 |

(Continued)

*Primary Examiner* — Christine S. Kim

(74) *Attorney, Agent, or Firm* — Scully Scott Murphy & Presser

(57) ABSTRACT

An electron gun, an X-ray source and a CT device are provided. The electron gun includes a body having a first end portion and a second end portion opposite to each other, wherein the first end portion is a connecting end portion; an internal cavity is formed in the body and has an opening positioned on the second end portion; a cathode, a grid, a compensation electrode and a focus electrode, orderly arranged in the internal cavity in a direction from the first end portion to the second end portion.

19 Claims, 3 Drawing Sheets

(56) References Cited

U.S. PATENT DOCUMENTS

| | | | | |
|---|---|---|---|---|
| 8,588,372 | B2 * | 11/2013 | Zou | H01J 35/065 378/113 |
| 2011/0222665 | A1 * | 9/2011 | Morton | H01J 35/12 378/141 |
| 2015/0124931 | A1 | 5/2015 | Koninklijke | |

FOREIGN PATENT DOCUMENTS

| | | | |
|---|---|---|---|
| CN | 101494149 | A | 7/2009 |
| CN | 206363980 | U | 7/2017 |

* cited by examiner

ELECTRON GUN AND X-RAY SOURCE AND CT DEVICE HAVING THE ELECTRON GUN

CROSS REFERENCE

This application is based upon and claims priority to Chinese Patent Application No. 201611247743.4, filed on Dec. 29, 2016, the entire contents thereof are incorporated herein by reference.

TECHNICAL FIELD

The present disclosure relates to an electron gun, an X-ray source and a CT device having the electron gun.

BACKGROUND

X-ray is widely used in the fields of industrial non-destructive test, safety inspection, medical diagnosis and treatment. In particular, X-ray radiographic imaging devices owing to the high penetration performance of X-rays play an important role in all aspects of people's daily life. These devices were presented as film-based planar fluoroscopic imaging devices previously. At present, these devices with advanced technology are regarded as stereoscopic imaging devices with digital, multi-view; and high-resolution, for example computed tomography (CT), which may acquire high-resolution 3D stereoscopic image or slicing image as an advanced high-end application.

In the existing CT device, the X-ray generating device moves on the slip ring, in order to improve inspecting speed, moving speed of the X-ray generating device is usually quite fast, and thereby decreases reliability and stability throughout the device. In addition, due to limitation of the moving speed, the inspecting speed of the CT is also limited, so that inspection efficiency is lower. Furthermore, the X-ray sources of such devices move on the slip ring to cause focus of the equivalent X-ray sources larger such that the imaged pictures have motion artifacts and poor in the imaged images, poor resolution, and there is a possibility of missing inspection for some smaller contrabands. Besides, such devices may only inspect stationary (or slow-moving) objects but almost cannot form a three-dimensional image for the moving object.

Hot cathodes serve as electronic emission units and are arranged in array. The voltage between the hot cathode grids is used to control emission of electrons so as to control each cathode to emit electrons in sequence and to bombard target points on the anodes in the corresponding sequence, to establish a arranged X-ray source. By using an electronic switch instead of mechanical rotation of a spiral CT, the X-ray source may be rapidly generated from many views to rapidly image in different angles. This method may greatly improve inspection efficiency and enhance sharpness of the images. And, this scheme structure is simple, the system is stable and the reliability is higher.

In order to improve imaging quality of arranged light sources, it is generally required that light sources from the arranged light source are determined in a range of several tens to hundreds (as required), which means that a large amount of cathodes are required. The current design scheme is provided such that the cathode, a beam control electrode (grid), a compensation focus electrode are integrated together, if one of the cathodes (or cathode assembly) malfunctions, detaching and replacing are very complicated. Thus, the current design scheme is very inconvenient in terms of maintenance and replacement of a equipment.

The contents as above disclosed in this background are only employed to enhance understanding the technical background of this disclosure, thereby the existing knowledge that are not well-known for those skilled in the art may be included in this disclosure.

SUMMARY

Additional aspects and advantages of this disclosure will be set forth in part in the description and will be obvious in part from the description, or may be learned by implementation of this disclosure.

According to one aspect of this disclosure, an electron gun includes a body having a first end portion and a second end portion opposite to each other, wherein the first end portion is a connecting end portion; an internal cavity s formed in the body and has an opening positioned on the second end portion; and a cathode, a grid, a compensation electrode and a focus electrode, orderly arranged in the internal cavity in a direction from the first end portion to the second end portion.

According to another aspect of s disclosure, an X-ray source includes a vacuum chamber; an anode target provided in the vacuum chamber; a mounting plate provided in the vacuum chamber and separated from the anode target; and a plurality of electron guns according to present disclosure fixedly connected to the mounting plate, the compensation electrodes of the plurality of the electron guns are connected to one another by compensation connection lines, the focus electrodes are connected to one another by focus connection lines, and both the compensation connection lines and the focus connection lines are connected to a compensation focus power supply.

According to another aspect of this disclosure, a CT device includes the X-ray source as above mentioned.

BRIEF DESCRIPTION OF THE DRAWINGS

The foregoing features and advantages of the present disclosure will become more apparent from the following detailed description of the present disclosure when taken in conjunction with the accompanying drawings.

Figure 1:
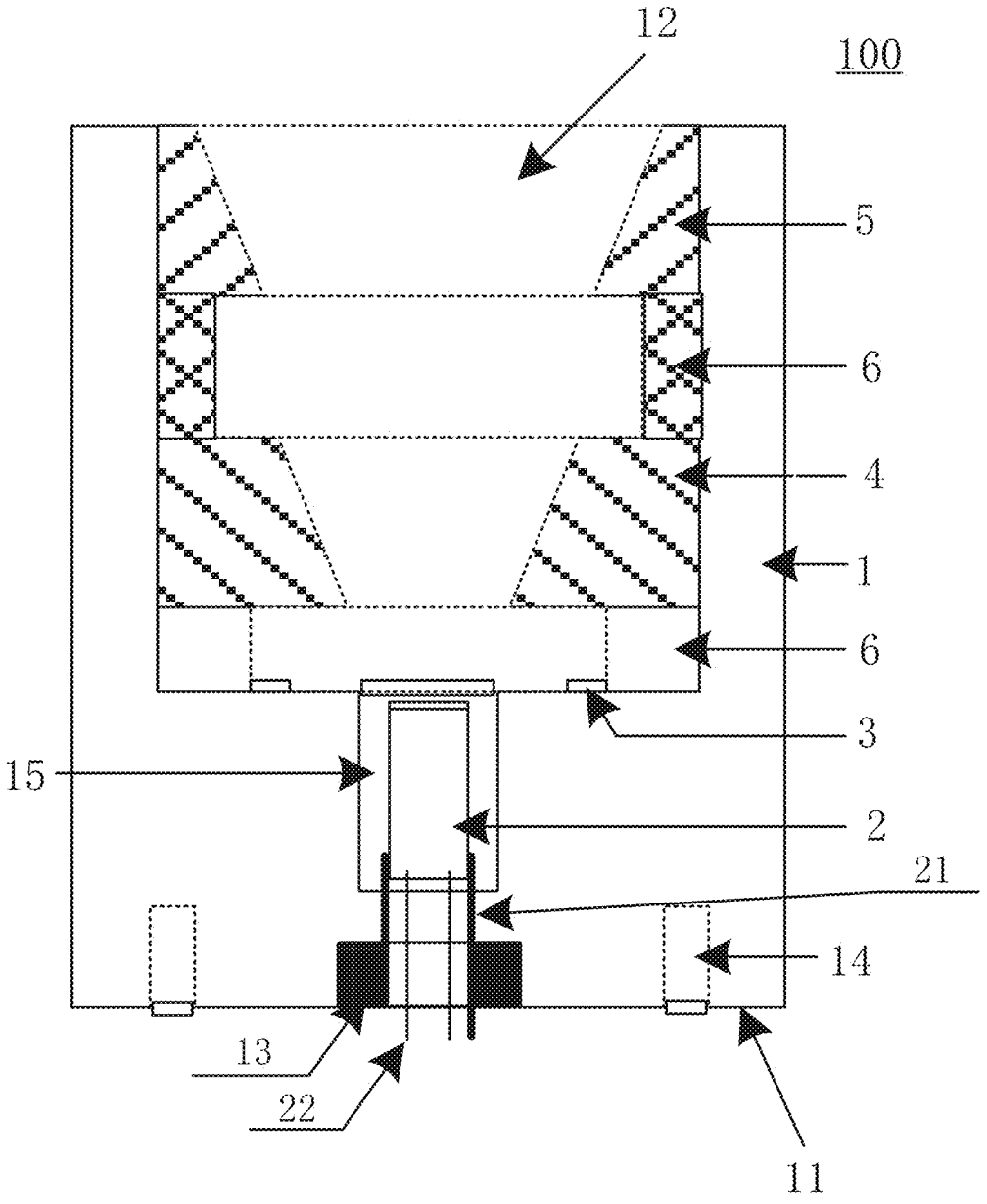
FIG. 1 is a schematic view of an electron gun according to an embodiment of this disclosure.

In the drawings, 1. body; 10. electron beam; 11. connecting end portion; internal cavity; 13. metal fixing ring; 14. threaded bore; 15. cave body; 2. cathode; 21. support leg; filament; 23. surface lead; 24. bolt; 25, welding spot; 3. grid; 4. compensation electrode; 41. compensation connection line; 5. focus electrode; 51. focus connection line; 6. ceramic piezoelectric ring; 7. vacuum chamber; 8. anode target; 9. mounting plate; 100. electron gun; 110. compensation focus power supply; 120. High-voltage power supply; 130. high-voltage connection device.

DETAILED DESCRIPTION

Exemplary embodiments will be completely described with reference to the drawings. This disclosure may, however, be embodied in many different forms and should not be construed as limited to the exemplary embodiments set forth herein. Rather, these exemplary embodiments are provided so that this disclosure is thorough and complete, and will fully convey the scope of this disclosure to those skilled in the art. The same reference numbers will be used throughout the drawings to refer to the same or like parts, thereby the detailed description thereof will be omitted.

As shown in FIG. 1, an embodiment of the present disclosure discloses an electron gun, which is used for generating X-ray, and thereby can be used in an X-ray source and a CT device. The electron gun 100 according to this embodiment includes a body 1, a cathode 2, a grid 3, a compensation electrode 4 and a focus electrode 5.

The body 1 serves as a basic structure and has a substantially cylindrical outline. The structure maim body 1 has a first end portion and a second end portion opposite to each other, wherein the first end portion is a connecting end portion 11, an internal cavity 12 forms in the interior of the body 1 and has an opening on the second end portion. That is to say, the body 1 is a structure that is closed on one end and is opened on the other end, in this embodiment, the body 1 is a ceramic body, but not limited to this disclosure. The cathode 2, the grid 3, the compensation electrode 4 and the focus electrode 5 are orderly arranged in the internal cavity 12 in a direction from the first end portion to the second end portion.

As can be seen from FIG. 1, a cave body 15, in which a cathode 2 is provided, is arranged on the bottom of the internal cavity 12. The cave body 15 can position the cathode 12 substantially on the central axis of the body 1. In this embodiment, the cathode 2 is a hot cathode, and the filament 22 of the cathode 2 can be heated by electricity when the cathode is switched on. The cathode 2 is provided with support legs 21. Metal fixing rings 13 are arranged outside the connecting end portion 11 of the body 1 and may be connected onto the body 1 in a metalized welding manner, that is, the metal fixing rings 13 are metalized firstly on the body 1 of the ceramic body to form a metal film, and subsequently welded to the metal film, whereas the support legs 21 pass through the body 1 to be welded to the metal fixing ring 13.

Since the support legs 21 are connected to the surface of the cathode 2, emitted current of the cathode 2 will flow out via the support legs 21, and the filament 22 of the cathode 2 will be led out of the internal cavity 12 of the body 1 and exposed to the connecting end portion 11, as a result, the filament 22 is connected to the power supply. A distance between the cathode 2 and the grid 3 can be adjusted by adjusting length of the support legs 21. It should be understood for the person skilled in the art that position where the filament 22 of the cathode 2 can be led out of the internal cavity 12 is not limited, for example, can be led out of the side wall of the body 1.

The grid 3 is positioned outside the cathode 2. The grid 3 when connecting to the body also is metalized on the body, and then welded onto the metal film of the body 1. The grid 3 is used to control whether the cathode 2 emits electrons or not. The cathode 2 is switched off and thereby does not emit the electrons when the grid 3 is under a negative bias voltage, and the cathode 2 may emit electrons when the grid 3 is under a positive bias voltage.

As shown in FIG. 1, ceramic piezoelectric rings 6 are provided both between the compensation electrode 4 and the focus electrode 5 and between the compensation electrode 4 and the grid 3, respectively. The ceramic piezoelectric ring 6 is an annular structure and has a cross section in a rectangular or circular shape etc. As assembling, the compensation electrode 4 and the focus electrode 5 are pressed into the internal cavity 12 layer by layer by using the ceramic piezoelectric ring 6. The ceramic piezoelectric ring 6 may also be a specified distance separated between the grid 3, the compensation electrode 4 and the focus electrode 5. In use, the thickness of the above two ceramic piezoelectric rings 6 may be same or different from each other. In this embodiment, the ceramic piezoelectric ring 6 closer to the inside has a thinner thickness. It should be noted that the ceramic piezoelectric ring 6 may not be disposed between the focus electrode 5 and the compensation electrode 4. The focus electrode 5 can also be welded to the body 1, and an edge of the focus electrode 5 is welded to the metalized body 1. An appropriate voltage is applied on the compensation electrode 4 for adjusting the electric field strength on both ends of the grid 3, to ensure that the electron has the smallest increase of the emittance after passing through the grid 3, thereby focusing of the beam current becomes easier. The voltage of the compensation electrode 4 is properly raised to reduce rate of the electrons captured by the grid 3 and improve the electron utilization rate. Voltage of the focus electrode 5 can be adjusted to focus the beam current to a right dimension. The compensation electrode 4 and the focus electrode 5 may be annular, and the cross sections of the compensation electrode 4 and the focus electrode 5 may be trapezoidal, rectangular, circular, etc.

Threaded bores 14 are provided on the connecting end portion 12. The threaded bores 14 are used for screwing bolts in to secure the body 1. Numbers of the threaded bores 14 are preferably four, and these threaded bores 14 are evenly distributed along the axis circumference of the body 1.

Figure 2:
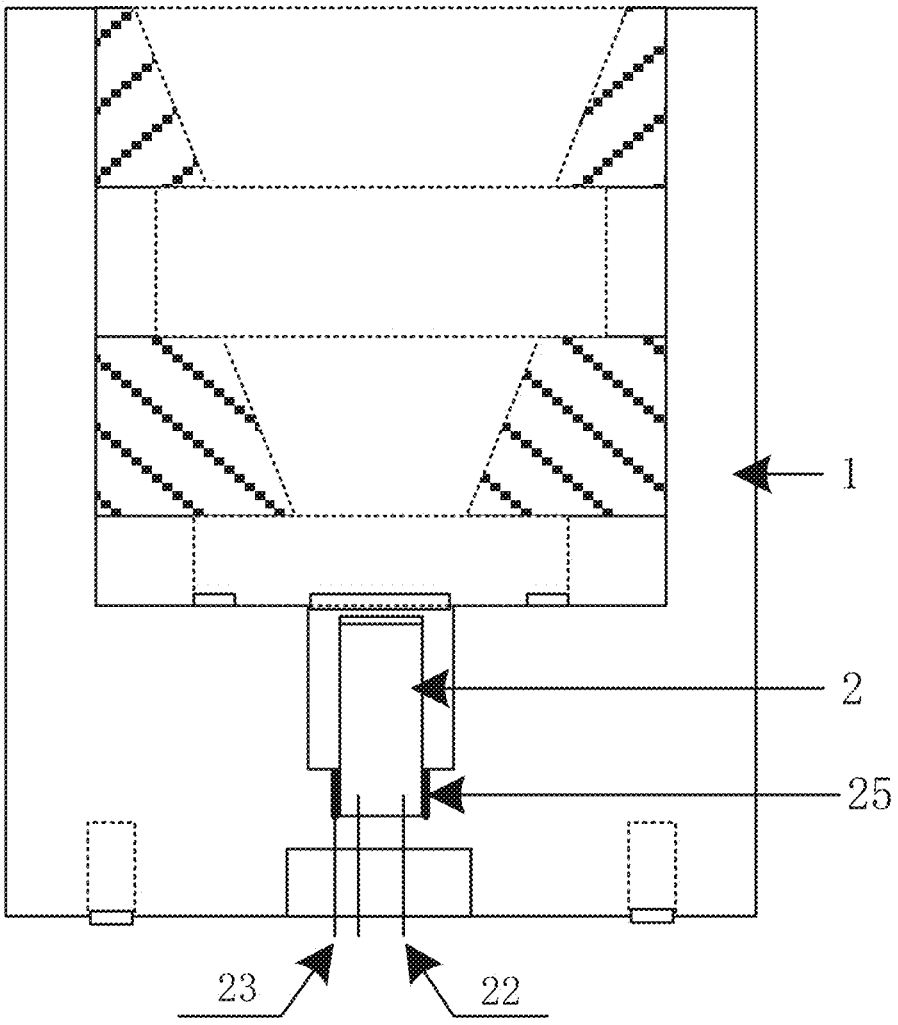
FIG. 2 is a schematic view of the electron gun according to another embodiment of this disclosure.

Referring to FIG. 2 which is a schematic view of the electron gun 100 according to another embodiment of this disclose. In this embodiment, the cathode 2 is not provided with the support legs, but the lower portion of the cathode 2 is directly welded to the body 1 by means of the welding spots 25. The filament 22 of the cathode 2 is still led out through the outer wall of the body 1. The surface lead 23 of the cathode 2 is also led out through the rear wall of the structure body 1. The electron gun 100 according to this embodiment further simplify the structure.

According to the above embodiment, the electron gun 100 of this disclosure has the body 1 as a protector, in which the cathode 2, the grid 3, the compensation electrode 4 and the focus electrode 5 all are accommodated, and thereby forming a complete component structure. As assembling, the body 1 merely needs to be wholly mounted in the X-ray source, which makes the use of the electron gun 100 more conveniently, simplifies assembling process of the electron gun 100, and makes the replacement more easily and thereby reducing the maintenance cost of the device.

Figure 3:
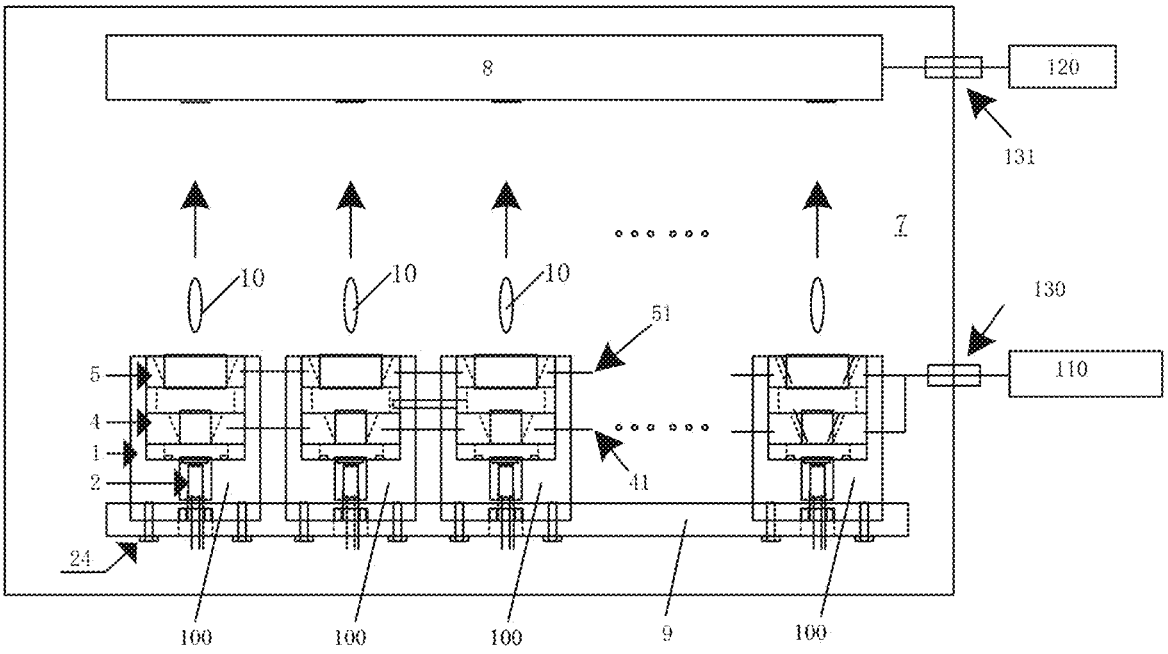
FIG. 3 shows an X-ray source of the electron gun as shown in FIG. 1.

As shown in FIG. 3, this disclosure discloses an X-ray source. The X-ray source includes a vacuum chamber 7, an anode target 8, a mounting plate and the electron gun 100 as illustrated in the embodiments of this disclosure.

Both anode target 8 and the mounting plate 9 are provided in the vacuum chamber 7, are separated from each other and are substantially parallel to each other. A plurality of electron guns 100 are connected to the bolts 24 of the mounting plate 9 via the threaded bores 23 of the connecting end portion 12, and thereby being fixed on the mounting plate 9. These electron guns 100 can emit electron beam 10 to the anode target. These electron beam 10 fly toward the anode target 8 from the electron guns 100 in an arrow direction of FIG. 3, and the anode target 8 collects the electron beam, and thereby the energy of the electron beam is converted to X-ray. The compensation electrode 4 of these electron guns are connected to one another by means of the compensation connection lines 41, and the focus electrodes 5 are connected to one another by means of the focus connection lines 51. The compensation connection lines 41 and the focus connection lines 51 are simultaneously connected to one high-voltage connection device 130, and then connected to one compensation focus power supply 110 via the high-voltage connection device 130. The anode target 8 is connected to the high-voltage power supply 120 by a high-voltage connection device 131. In the X-ray source of this disclosure, the anode target is at a high positive pressure, the cathode 2 is at a ground potential, and the grid 3, the focus electrode 5 and the compensation electrode 4 are at a low positive pressure. These electron guns 100 are arranged in array on the mounting plate 9 according to the requirements.

According to the X-ray source of this disclosure, the electron guns thereof can be mounted on the mounting plate 9 conveniently and quickly, and thereby simplifying the structure and facilitating for manufacture.

This disclosure further discloses a CT device having the X-ray source, and the electron guns in the CT device can be mounted in the X-ray source easily.

The electron gun of this disclosure can be wholly mounted on the X-ray source by mounting the cathode, the grid, the compensation electrode and the focus electrode in the internal cavity of the body, such that the electron gun has a simple structure, can be assembled easily, and can be mounted or replaced quickly.

While the present disclosure has been described in detail in connection with the exemplary embodiments, it should be readily understood that the present disclosure is not limited to such disclosed embodiments. Rather, various alternations and equivalents of such metes and bounds are therefore intended to be embraced by the appended claims.

What is claimed is:

1. An electron gun, comprising:

a body having a first end portion and a second end portion opposite to each other, wherein the first end portion is a connecting end portion; an internal cavity is formed in the body and has an opening positioned on the second end portion; and a cathode, a grid, a compensation electrode and a focus electrode, orderly arranged in the internal cavity in a direction from the first end portion to the second end portion, wherein ceramic piezoelectric rings are disposed between the compensation electrode and the focus electrode, and between the compensation electrode and the grid, respectively.

2. The electron gun according to claim 1, wherein the body is a ceramic body.

3. The electron gun according to claim 1, wherein a metal fixing ring is arranged outside the connecting end portion of the body, and the cathode has support legs which pass through the body and are welded to the metal fixing ring.

4. The electron gun according to claim 1, wherein the grid and the focus electrode are welded to the body.

5. The electron gun according to claim 1, wherein threaded bores are formed on the end surface of the connecting end portion.

6. The electron gun according to claim 1, wherein the body is cylindrical, and the compensation electrode and the focus electrode are circular.

7. The electron gun according to claim 1, wherein the cathode is welded to the bottom of the internal cavity.

8. An X-ray source, comprising:

a vacuum chamber;

an anode target provided in the vacuum chamber;

a mounting plate provided in the vacuum chamber and separated from the anode target; and a plurality of electron guns according to claim 1 fixedly connected to the mounting plate, the compensation electrodes of the plurality of the electron guns are connected to one another by compensation connection lines, the focus electrodes are connected to one another by focus connection lines, and both the compensation connection lines and the focus connection lines are connected to a compensation focus power supply.

9. The X-ray source according to claim 8, wherein the body is a ceramic body.

10. A CT device, comprising the X-ray source according to claim 9.

11. The X-ray source according to claim 8, wherein a metal fixing ring is arranged outside the connecting end portion of the body, and the cathode has support legs which pass through the body and are welded to the metal fixing ring.

12. A CT device, comprising the X-ray source according to claim 11.

13. The X-ray source according to claim 8, wherein ceramic piezoelectric rings are disposed between the compensation electrode and the focus electrode, and between the compensation electrode and the grid, respectively.

14. The X-ray source according to claim 13, wherein the grid and the focus electrode are welded to the body.

15. A CT device, comprising the X-ray source according to claim 13.

16. The X-ray source according to claim 8, wherein threaded bores are formed on the end surface of the connecting end portion.

17. The X-ray source according to claim 8, wherein the body is cylindrical, and the compensation electrode and the focus electrode are circular.

18. The X-ray source according to claim 8, wherein the cathode is welded to the bottom of the internal cavity.

19. A CT device, comprising the X-ray source according to claim 8.

* * * * *